US005873604A

United States Patent [19]

Phillips

[11] Patent Number: 5,873,604

[45] Date of Patent: Feb. 23, 1999

[54] DOCUMENT SECURITY SYSTEM HAVING THERMO-ACTIVATED PANTOGRAPH AND VALIDATION MARK

[75] Inventor: George K. Phillips, Paso Robles, Calif.

[73] Assignee: Verify First Technologies, Inc., Paso Robles, Calif.

[21] Appl. No.: 602,243

[22] Filed: Feb. 16, 1996

Related U.S. Application Data

[63] Continuation-in-part of Ser. No. 450,975, May 25, 1995, Pat. No. 5,704,651, and Ser. No. 568,587, Dec. 7, 1995, Pat. No. 5,772,248.

[51] Int. Cl.[6] ..... B42D 15/00

[52] U.S. Cl. ..... 283/70; 283/72; 283/58

[58] Field of Search ..... 213/67, 70, 93, 213/94, 95, 91, 901, 902, 58

[56] References Cited

U.S. PATENT DOCUMENTS

| | | | |
|---|---|---|---|
| 1,998,237 | 4/1935 | Himmell . | |
| 3,282,720 | 11/1966 | Oleksiw . | |
| 3,802,724 | 4/1974 | Gosnell | 283/9 |
| 4,025,673 | 5/1977 | Reinnagel | 428/29 |
| 4,066,280 | 1/1978 | La Capria | 283/8 |
| 4,082,426 | 4/1978 | Brown | 350/105 |
| 4,151,666 | 5/1979 | Raphael et al. | 40/2.2 |
| 4,163,570 | 8/1979 | Greenaway | 283/8 |
| 4,168,088 | 9/1979 | Somlyody | 283/8 |
| 4,175,774 | 11/1979 | Tonges et al. | 283/6 |
| 4,175,776 | 11/1979 | Ranauro | 283/8 |
| 4,184,700 | 1/1980 | Greenaway | 283/6 |

(List continued on next page.)

FOREIGN PATENT DOCUMENTS

| | | | |
|---|---|---|---|
| 965125 | 3/1975 | Canada | 283/901 |

OTHER PUBLICATIONS

McGarry, Dennis, "Document Security", *Technical Update–National Business Forms Association,* Dec. 1, 1990, pp. 3–8.

National Business Forms Association, "Watermarked and Non–Impact Papers", *Technical Report,* Aug. 17, 1987, vol. 1, No. 8, T.U. #32 (LLB), pp. 1–3.

The Standard Registry Company, "Making It Easy for People to Be Honest—Three Steps to Document Security", *Standard Register,* Form No. 5463 4.89–1, 1990, pp. 1–6.

McLoone, Sharon, "Inks That Are Mightier Than the Counterfeiter", *Form,* May 1995, pp. 88, 90, 93.

Steven S. Scaman et al., "Security Indicator Inks Gain Market Prominence", *Flexo,* Dec. 1994, pp. 14, 16–17.

*Primary Examiner*—Willmon Fridie, Jr.
*Attorney, Agent, or Firm*—Lyon & Lyon LLP

[57] ABSTRACT

A document protection system is disclosed which employs a thermochromic pantograph and a validation mark. Also disclosed is a method to print thermochromic pantographs onto a substrate. A thermochromic pantograph according to the present invention has a latent image which is rendered visible when sufficient heat is applied to the document to activate the reactive properties of the thermochromic ink. The latent image could form a warning message such as "STOP" or "ALERT" which would alert recipients that a counterfeit copy has potentially been created. The thermochromic pantograph may also comprise a camouflage background pattern which conceals the printed ink of the latent image. A validation mark preferably has a latent "validation" image which can be visually identified on an original document, but which cannot be accurately reproduced by conventional copying or scanning means, and thus will not be visible on an unauthorized copy or duplicate. The use of both thermochromic pantograph and validation mark in the present invention provides multiple levels of protection against the unauthorized alteration or counterfeiting of valuable documents. Used in conjunction, these features allow the present invention to provide efficient and effective protection against unauthorized alterations and counterfeits.

32 Claims, 5 Drawing Sheets

U.S. PATENT DOCUMENTS

| | | | |
|---|---|---|---|
| 4,227,719 | 10/1980 | McElligot et al. | 283/8 |
| 4,265,469 | 5/1981 | Mowry et al. | 283/8 |
| 4,303,307 | 12/1981 | Tureck | 350/276 |
| 4,307,899 | 12/1981 | Hoppe | 283/7 |
| 4,341,404 | 7/1982 | Mowry et al. | 283/8 |
| 4,351,547 | 9/1982 | Brooks, II | 283/8 |
| 4,455,039 | 6/1984 | Weitzen et al. | 283/83 |
| 4,522,429 | 6/1985 | Gardner et al. | 283/91 |
| 4,534,398 | 8/1985 | Crane | 162/103 |
| 4,579,370 | 4/1986 | Corwin et al. | 283/72 |
| 4,588,212 | 5/1986 | Castagwoli | 283/91 |
| 4,629,630 | 12/1986 | Devrient | 427/7 |
| 4,715,623 | 12/1987 | Ronle et al. | 283/91 |
| 4,795,894 | 1/1989 | Sugimoto et al. | 235/468 |
| 4,867,481 | 9/1989 | Gundijan et al. | 283/91 |
| 4,869,532 | 9/1989 | Abe et al. | 283/88 |
| 4,892,385 | 1/1990 | Webster, Jr. et al. | 350/162.23 |
| 4,988,126 | 1/1991 | Hedenkamp et al. | 283/92 |
| 5,029,901 | 7/1991 | Dotson et al. | 462/8 |
| 5,044,707 | 9/1991 | Mallik | 359/2 |
| 5,093,184 | 3/1992 | Edwards | 428/192 |
| 5,137,304 | 8/1992 | Silverschotz | 283/100 |
| 5,149,140 | 9/1992 | Mowry, Jr. et al. | 283/93 |
| 5,190,318 | 3/1993 | Mantegazza | 283/82 |
| 5,197,765 | 3/1993 | Mowry, Jr. et al. | 283/93 |
| 5,271,645 | 12/1993 | Wicker | 283/92 |
| 5,344,192 | 9/1994 | Phillips | 283/91 |
| 5,454,598 | 10/1995 | Wicker | 283/67 |
| 5,636,874 | 6/1997 | Singer | 283/94 |

FIG. 12
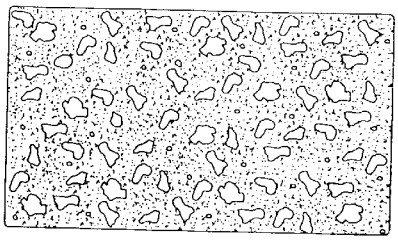
FIG. 13
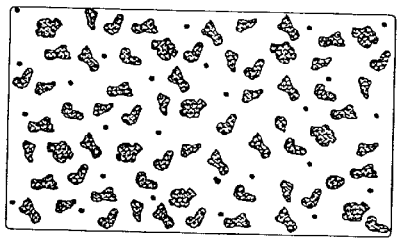
FIG. 14
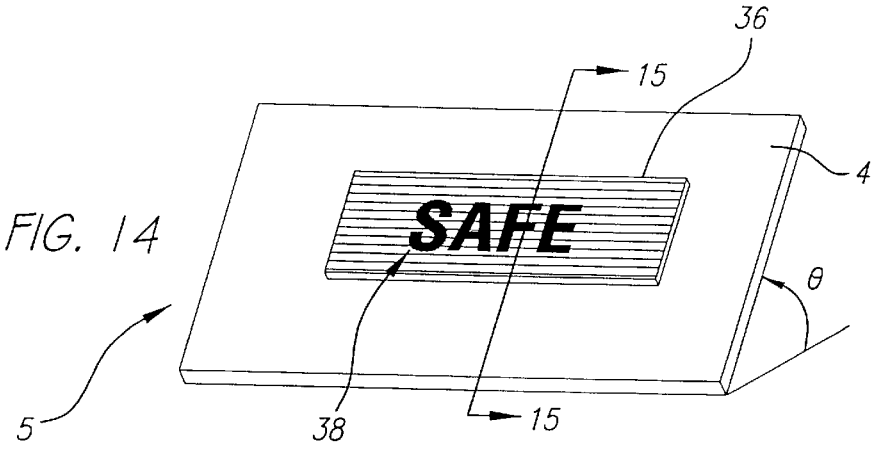
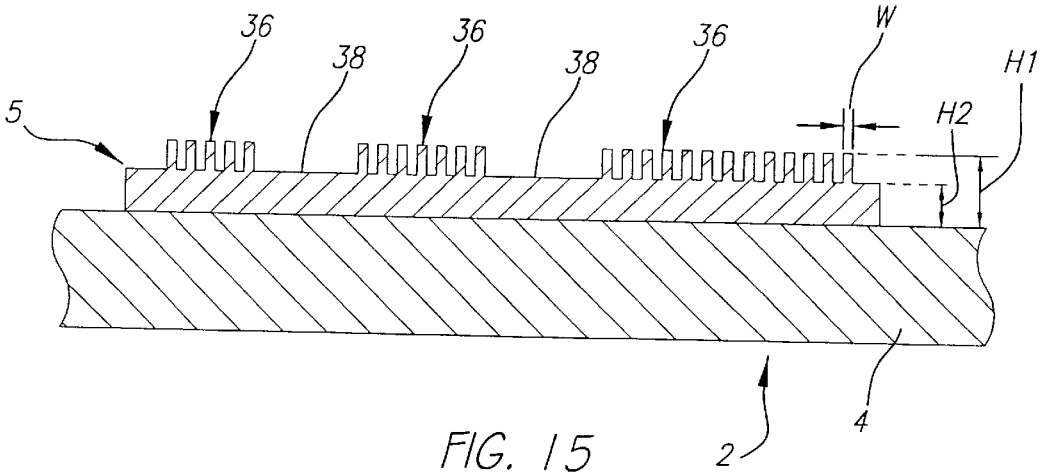
FIG. 15

DOCUMENT SECURITY SYSTEM HAVING THERMO-ACTIVATED PANTOGRAPH AND VALIDATION MARK

CROSS-REFERENCE TO RELATED APPLICATION

This application is a continuation-in-part of U.S. application Ser. No. 08/450,975, filed May 25, 1995 now U.S. Pat. No. 5,704,651 and U.S. appplication Ser. No. 08/568,587, filed Dec. 7, 1995 now U.S. Pat. No. 5,772,248.

BACKGROUND OF THE INVENTION

1. Field of the Invention

The field of the invention pertains to the prevention and detection of the unauthorized tampering or counterfeiting of valuable documents. In particular, the field of the present invention pertains to the use of thermo-activated pantographs and validation marks to protect against the unauthorized alteration and counterfeiting of documents.

2. The Related Art

Presently known approaches for recognizing altered, duplicate or counterfeit copies of original documents have generally sought to prevent alteration, duplication or counterfeiting of documents by physical alteration, electronic scanning or xerographic photocopying by printing information on the document in specially designed inks or other printing materials so that the printed information can be viewed on the original, but due to the unique color, texture, or reflective properties of the printed information on the altered or counterfeited copy, will be readily discernable from the original.

For example, U.S. Pat. No. 4,066,280 to LaCapria describes a document upon which is printed a specularly reflective coloring material such as powdered aluminum, which is not accurately reproduced by color copiers. The duplicate image will appear in different colors than on the original.

Similarly, U.S. Pat. No. 4,988,126 to Heckenkamp et al. describes an original document having surface relief in the form of embossed characters. A luminescent substance is formed into raised or depressed areas of the surface relief. The reflective properties of the surface relief render the original readily discernable from a photocopy which lacks the surface relief.

U.S. Pat. No. 4,082,426 describes retroreflective sheet materials formed of a monolayer of microsphere-lenses overlaying a specularly reflective layer coated over a polymeric material. A transparent image layer of varying thickness permits light rays to be transmitted to and reflected by the specularly reflective layer behind the image layer. The varying thickness of the image layer and the spacing between the specularly reflective layer and the microsphere-lenses changes the reflective characteristics of the sheeting, so that markings on the sheet are visible only from certain angles under retroreflective viewing conditions.

U.S. Pat. No. 4,892,385 to Webster, Jr. et al. describes an authenticating device which can be bonded to the surface of a document to identify an original document.

Another approach has been to provide specially manufactured copy-resistant paper upon which information of any kind can be printed using conventional processes and inks. For example, U.S. Pat. No. 4,867,481 to Gundjian describes copy-resistant paper having a two-color grid-like pattern printed over its surface, with each color having the same spectral profile but different spectral response. U.S. Pat. No. 4,303,307 to Tureck et al. describes a paper substrate coated with specially sized and spaced beads which break up incident light emitted by a photocopier. U.S. Pat. No. 5,093,184 to Edwards describes security paper having elongated metallic elements embedded in the paper.

Yet another approach has been to provide specially designed inks or other printing materials having different or unique color or reflective properties. For example, U.S. Pat. No. 5,271,645 to Wicker describes a color-copier resistant pigment consisting of print stuff mixtures obtained by mixing commercially available pigments with fluorescence compound.

U.S. Pat. No. 4,869,532 to Abe et al. describes a print produced by printing or coating an infrared reflective coloring agent and another printing ink containing an infrared absorptive coloring agent in combination on a base material, to produce visually-recognizable information along with other information recognizable with the aid of infrared lighting.

U.S. Pat. No. 4,025,673 and U.S. Pat. No. 3,887,742 to Reinnagel describe prevention of photocopying by selection of different color or color filter combinations for the text and background.

U.S. Pat. No. 4,175,776 to Ranauro describes a document in which the text and background are characterized by different optical reflectivities for incident visible light and which are substantially non-absorbing with respect to incident light having wavelengths within the response spectrum of color xerographic copying machines. When the document is photocopied, the incident light of the photocopier produces a uniform reflected pattern over the indicia which causes the indicia to "drop out" of the copy.

U.S. Pat. No. 4,522,429 to Gardner et al. discloses a document upon which text is printed upon colored paper having a reflection spectral response of less than about ten percent for light of below 600 millimicron wavelength, so that the color is sufficiently contrasting with the text to be visible when viewed under white light, but cannot be successfully photocopied.

SUMMARY OF THE INVENTION

The present invention comprises a document protection system which employs one or more thermochromic pantographs and one or more validation marks to protect against unauthorized duplicating or counterfeiting.

A thermochromic pantograph according to the present invention comprises a latent image which is normally concealed or obscured, but which is rendered visible when sufficient heat is applied to the document to activate the reactive heat crystals of the thermochromic ink. The latent image may be configured or printed to form a warning message such as "STOP" or "ALERT" which would alert recipients that a counterfeit copy has potentially been created. The thermochromic pantograph may also comprise a camouflage background pattern which conceals the printed ink of the latent image.

A validation mark preferably comprises a latent "validation" image which can be visually identified on an original document, but which is non-reproducible by conventional copying or scanning means, and thus will not be visible on an unauthorized copy or duplicate.

The use of one or more thermochromic pantographs and validation marks in the present invention provides multiple levels of protection against the unauthorized alteration or counterfeiting of valuable documents. When unauthorized attempts to photocopy or electronically scan a valuable document are attempted, a camouflaged latent warning image such as "ALERT" or "STOP" is visible on the face of the document and any copies resulting to deter the use of such counterfeits. In addition, genuine original document are readily identifiable because of a latent "validation" image such as "SAFE" or "GENUINE" which can be rendered visible on the original, but which cannot be accurately duplicated on a copy. Used in conjunction, these features allow the present invention to provide efficient and effective protection against unauthorized alterations and counterfeits.

BRIEF DESCRIPTION OF THE DRAWING FIGURES

FIGS. 7–13 depict various background patterns which can be used with the present invention.

FIG. 14 depicts an embodiment of a validation mark according to the present invention viewed at relative angle θ.

FIG. 15 is a cross-sectional view of the validation mark of FIG. 14 at line B—B showing surface relief structures.

DETAILED DESCRIPTION OF THE PREFERRED EMBODIMENTS

Figure 1:
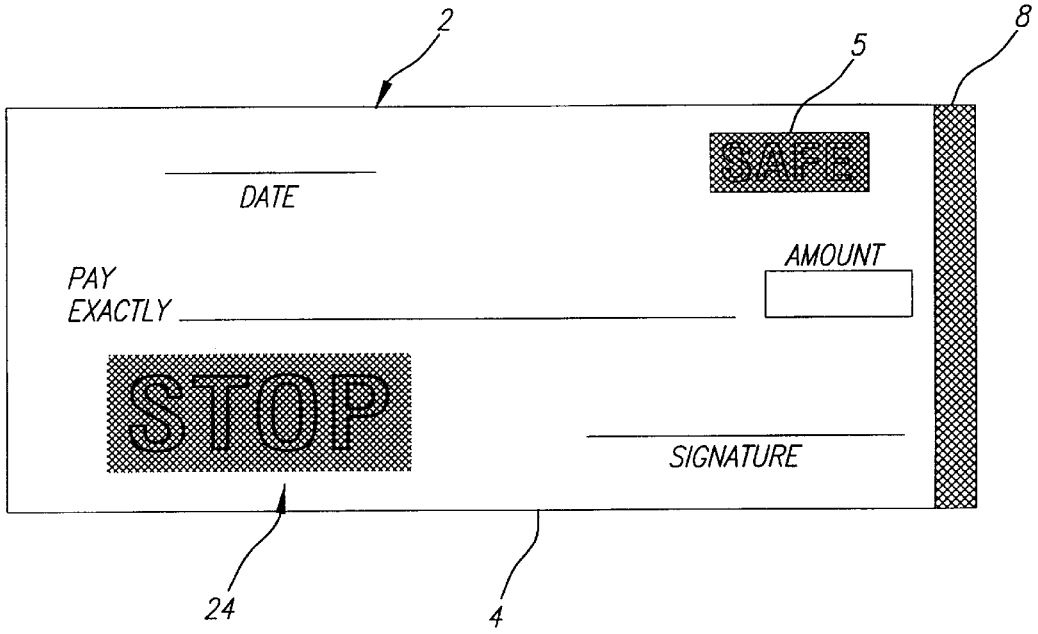
FIG. 1 depicts a document having a thermochromic pantograph and validation mark according to an embodiment of the present invention.

FIG. 1 depicts a document 2 comprising a substrate 4, thermochromic pantograph 24, and validation mark 5 according to an embodiment of the present invention. The substrate 4 is preferably of paper stock; however, any material suitable to the application may be used without departing from the scope of the present invention. The substrate 4 of the preferred embodiment comprises a smooth hard-surfaced paper, e.g., security twenty four (24) pound MOCR bond paper. It is anticipated that the present invention will be particularly suitable for checks and other documents of value, although the present invention is not limited to these applications and can be used in any application in which it is desirable to be able to prevent or detect the unauthorized alteration, reproduction or duplication of an original document.

For the purposes of illustration only, the thermochromic pantograph 24 and validation marks are shown in FIG. 1 located at the lower left and upper right corners of documents 2, respectively. However, these particular structures could be placed anywhere on the document 2, thus the placement shown in FIG. 1 is not limiting in any way. Further, these structures can be configured to be of any size or dimension, and may be configured to cover the entire surface of document 2. In addition, a plurality of these structures may be employed in the present invention.

Figure 2:
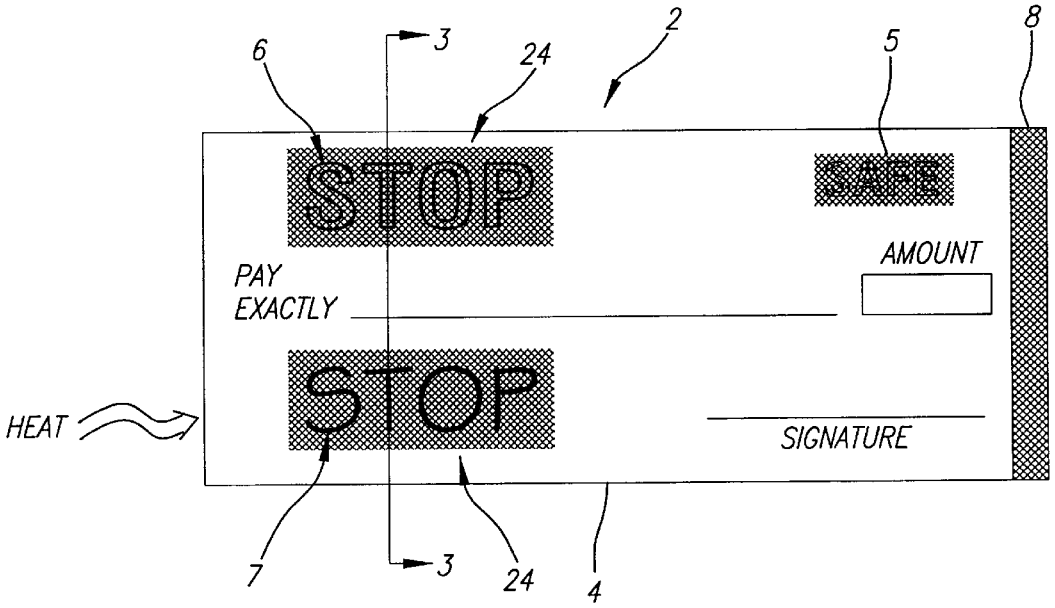
FIG. 2 depicts an embodiment of the present invention showing both a latent and a visible warning image.

Thermochromic pantograph 24 preferably comprises a latent image 6 (shown in phantom in FIG. 2 as the word "STOP") which is normally camouflaged and "invisible" on an original document 2. Latent image 6 is transformed into a visible image 7 when sufficient heat is applied to document 2 to activate the thermo-reactive properties of thermochromic pantograph 24. It is this reaction by thermochromic pantograph 24 to heat exposure that provides an efficient protection against counterfeiting and unauthorized duplications. In the preferred embodiment, document 2 comprises thermochromic pantograph 24 which contains a latent "warning" message or image (such as "ALERT" or "STOP") that is normally concealed, but which is rendered visible when document 2 is exposed to the radiant heat from a conventional electronic scanner or photocopier. Thus, attempts to duplicate the document 2 with a scanner or photocopier will render the latent warning message visible, ensuring that any resulting copy will bear the warning message on its face. A copy of document 2 bearing such a "warning" message instantly alerts the recipient to its nature as a potential counterfeit.

Validation mark 5 preferably comprises a latent "validation" image which can be visually identified on an original document, but which is non-reproducible by conventional copying or scanning means, and thus will not be visible on an unauthorized copy or duplicate. For example, the preferred validation mark 5 preferably has unique optical or reflective or spectral properties which renders the validation image visible only when the document is viewed at certain relative viewing positions or angles, but which renders the latent validation image invisible when viewed at an angle perpendicular relative to the surface of document 2. Since the typical "copy" position at the input face of a conventional scanner or photocopier is perpendicular relative to a document 2, the latent validation image will not be accurately reproduced on a copy or duplicate. In addition to validation marks 5 having these spectral/reflective properties, other validation marks 5 can be employed which comprise physical features, such as surface relief structures or slits, which cannot be reproduced by conventional means, and is thus readily distinguishable from a duplicate. Some examples of validation marks which may be employed in the present invention include those disclosed in: U.S. Pat. No. 5,344,192, issued Sep. 6, 1994 to George K. Philips; co-pending U.S. application Ser. No. 08/568,587, filed Dec. 7, 1995; co-pending U.S. application Ser. No. 08/450,975, filed May 25, 1995; and co-pending application Ser. No. 08/602,244, filed Feb. 16, 1996 now U.S. Pat. No. 5,762,378, which is being concurrently filed with the present application. The text and drawings of each of these references are hereby incorporated by reference in their entirety as if fully set forth herein.

The use of thermochromic pantograph 24 and validation mark 5 in the present invention provides multiple levels of protection against the unauthorized alteration or counterfeiting of valuable documents. When unauthorized attempts to photocopy or duplicate document 2 are attempted, a latent warning image such as "ALERT" or "STOP" is rendered visible on the face of the document and any resulting copies, which serve to deter the use of any such duplicates or counterfeits. In addition, genuine original document are identifiable because of a latent "validation" image such as "SAFE" or "GENUINE" which can be rendered visible only on the original, but which cannot be accurately duplicated on a copy. Used in conjunction, these features allow the present invention to provide efficient and effective protection against unauthorized alterations and counterfeits.

Figure 3:
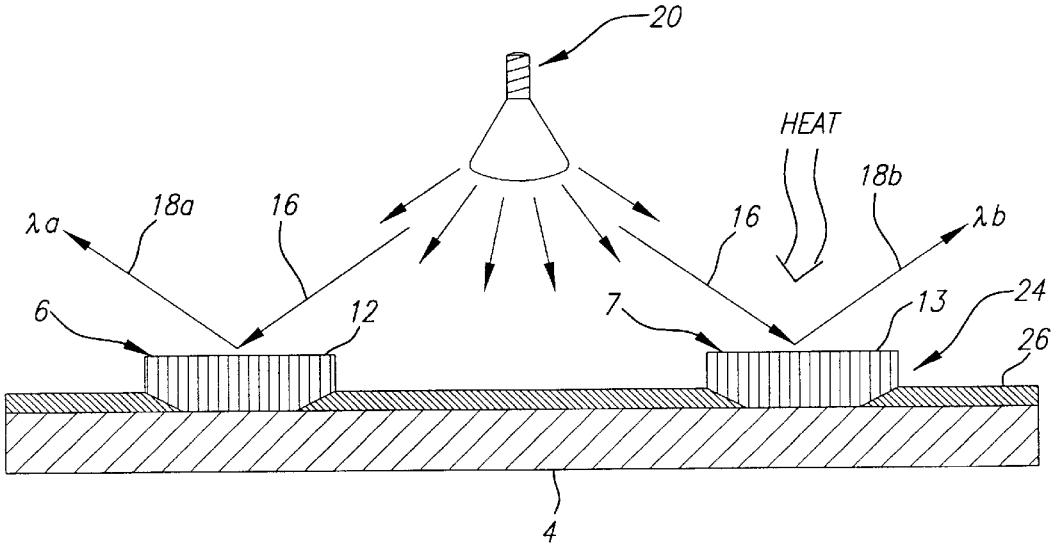
FIG. 3 is a cross-sectional view of the document of FIG. 2 at line A—A.

The preferred embodiment of thermochromic pantograph 24 comprises a latent image 6 which is concealed or obscured within the graphics of a camouflaged background pattern 26. Referring to FIG. 3, camouflage background pattern 26 preferably comprises a layer of non-thermochromic ink which is directly applied to the surface of substrate 4. Latent image 6 preferably comprises a layer of thermochromic ink 12 which is "trap produced" within the surrounding layer of ink forming camouflage background pattern 26. Alternatively, latent image 6 may comprise a layer of thermochromic ink which is directly overprinted on the base layer of ink forming camouflage background pattern 26. Yet, another embodiment may comprise a camouflage background pattern which is printed with thermochromic ink while the latent image is printed with a non-thermochromic ink. In this alternate embodiment, the latent image layer of ink is preferably applied directly to the substrate while the thermochromic ink of the camouflage background pattern is overprinted or trap produced within the latent image layer.

The preferred thermochromic ink 12 is formulated with heat crystals which renders the pigment portion of the ink subject to spectral changes when exposed to specific temperature levels. Thus, the preferred thermochromic ink 12 will undergo a visible change in color (i.e., hue and/or saturation) when exposed to the proper temperature range. The exact chemical composition of thermochromic ink 12 can be modified to adjust its thermo-reactivity to varying ranges of heat exposure, and the threshold thermo-activation point for thermochromic ink 12 is preferably specifically calibrated for the particular activity that is to be detected. For example, if one wishes to detect the duplication of documents by conventional photocopier devices, the threshold thermo-activation point for the thermochromic ink is preferably chosen to be just below the radiant temperature range at the input surface of a conventional photocopier. The preferred thermochromic ink is available from Chromatic Technologies, Inc., and is formulated to run wet offset at high speeds, e.g. greater than 500 feet per minute, and preferably between 500 to 1,000 feet per minute, and to print high resolution graphics without adverse toning, plugging, or tinting.

The exact composition of thermochromic ink 12 can be modified to determine the exact spectral/reflective qualities of the ink. Thus, the choice of inks would determine the color of the thermochromic ink 12 both before and after exposure to a sufficiently reactive level of heat. Alternatively, a thermochromic ink 12 may be selected which allows numerous distinct color changes over a plurality of temperature ranges, such that the final color of the ink would allow an observer to identify the exact temperature range the document 2 was exposed to. In the preferred embodiment, the thermochromic ink 12 reacts to heat by becoming "lighter" in color. For any particular application, selection criteria which may affect the choice of the exact colors and compositions for thermochromic ink 12 includes the type and color of material chosen for substrate 4 and the particular colors and graphics employed in camouflage background pattern 26.

As shown in FIG. 3, light source 20 generates incident light rays 16 which are emitted at the thermochromic ink 12 of latent image 6. In its inactivated state, the layer of thermochromic ink 12 will reflect light rays 18*a* at a wavelength λa and a chromacity coordinate of A(x,y). The composition and reflective properties of thermochromic ink 12 are preferably selected such that the visible color, hue, and/or saturation of reflected light rays 18*a* at wavelength λa and chromacity coordinate of A(x,y) will facilitate the concealment of latent image 6 within the camouflage background pattern 26. The particular choice of spectral/reflective qualities selected for latent image 6 for optimal concealment depends in large part upon the particular colors and graphics employed for the camouflaged background pattern 26.

FIG. 3 also depicts a layer of thermochromic ink 13 which has been exposed to sufficient heat to activate the thermochromic pantograph 24, thereby transforming a latent image 6 into a visible image 7. As stated above, thermochromic ink 13 comprises heat crystals which are activated such that the spectral qualities of the thermochromic ink layer 13 is modified, wherein the absorption properties of the thermochromic ink changes after application of heat. Thus, incident light rays 16 will reflect off thermochromic ink 13 as reflected light rays 18*b* at a wavelength λb and a chromacity coordinate of B(x,y). Because of the reactive spectral and absorption qualities of thermochromic ink, the reflected light wavelength λb and chromacity coordinate B(x,y) of the activated thermochromic ink 13 will be different than that of the reflected light wavelength λa and chromacity coordinate A(x,y) of inactivated thermochromic ink 12. The composition and reflective properties of thermochromic ink 13 are preferably selected such that the visible color, hue, and/or saturation of reflected light rays 18*b* at wavelength λb and chromacity coordinate of B(x,y) will contrast against the graphics of camouflage background pattern 26. Thus, rather than concealing the latent image 6, application of sufficient heat will allow the graphics of the camouflage background pattern to enhance the visibility of image 7.

The thermochromic ink 12 of thermochromic pantograph 24 can be formed such that the latent image 6 is rendered irreversibly and permanently visible when exposed to sufficient heat. Thermochromic pantograph 24 may also be configured such that the latent image 6 is rendered visible for only a designated time span when exposed to sufficient heat; in this case, the latent image 6 of the thermochromic pantograph 24 will return to its inactivated color after document 2 is removed from the activating heat source and can cool to its "inactive" temperature. Alternatively, the thermochromic pantograph 24 may be configured such that the original color of latent image 6 is restored when document 2 is exposed to another activating temperature range or to an exact sequence of other temperature ranges. The choice of permanence for the activation of the thermochromic ink 12 is determined by the particular application to which this invention is directed.

To optimally practice the present invention, the selection of the exact color, texture, and graphics for camouflage background pattern 26 should be coordinated with the selection of the exact color, texture, and reactive properties of the thermochromic ink 12. The thermochromic ink 12 of latent image 6 should be concealed against the camouflaged background pattern 26 when inactivated, but the thermochromic ink 12 is preferably rendered starkly visible when activated. The combination of certain colors with certain graphics patterns are more difficult to camouflage than others. For example, the combination of red ink with a linen pantograph makes it difficult to hide camouflaged indicia.

The particular graphics employed in the camouflage background pattern 26 plays a significant role in camouflaging the latent image 6. In general, the graphics pattern of camouflage background pattern 26 is preferably formed with a certain level of irregularity to its pattern to facilitate camouflaging of latent image 6. The more irregular patterns with a greater diversity of tones or alternating solid/open areas are the easiest to print and camouflage, but lose some effectiveness when digitally copied. On the other hand, the smoother, close together patterns are more difficult to print without noticing hidden indicia, but are much more effective when digitally copied.

Figure 4:
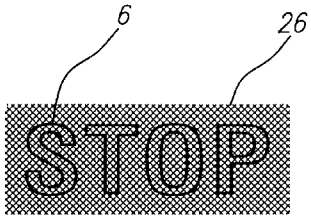
FIGS. 4–5 show embodiments of camouflage background patterns which can be used with the present invention.
Figure 5:
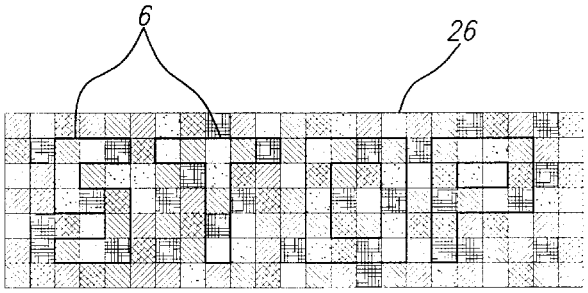

As shown in FIG. 4, a preferred camouflage background pattern 26 comprises a densely packed woven or linen pattern formed of intercrossing and interspaced lines. The latent image 6 is preferably overprinted or trapped within the layer of ink forming the background pattern. In one preferred embodiment, the latent image 6 is printed in a light blue color against a camouflaging background pattern 26 which is printed in a light red color. FIG. 5 shows an alternatively preferred background pattern 26 having regular pattern of shaded and/or colored blocks which contain an irregular distribution of shading/coloring for the individual blocks. The individual characters forming latent image 6 are preferably aligned within the contours of the blocks such that the image is effectively hidden. For the purposes of illustration only, the characters forming latent image 6 in FIGS. 4 and 5 are outlined to show a preferred placement of latent image 6 within the camouflage background pattern.

Figure 7:
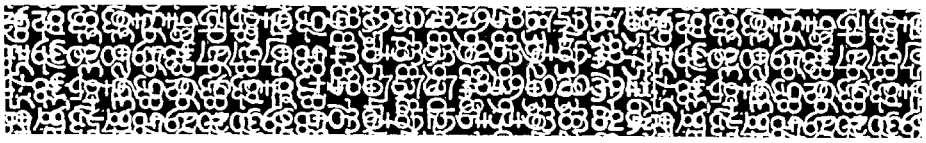
Figure 8:
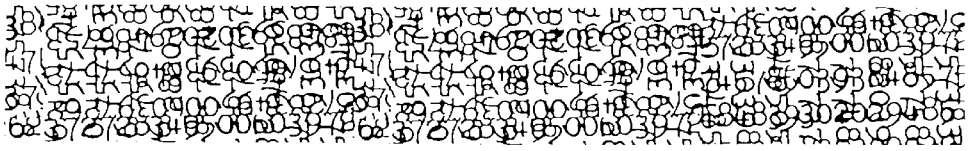
Figure 9:
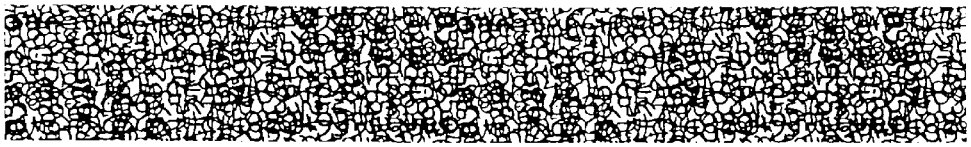
Figure 10:
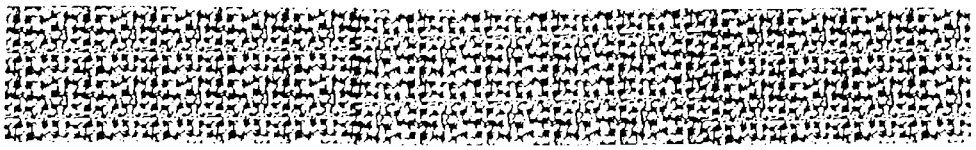
Figure 11:
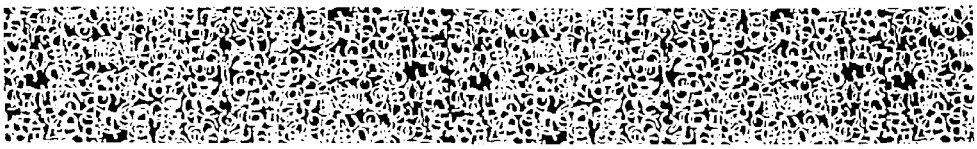

Several alternatively preferred background patterns are illustrated in FIGS. 7–13. FIG. 7 shows an example of a patterned background formed by randomly selected overlapping white numeric characters printed on a black background. FIG. 8 shows an example of a patterned background formed by randomly selected overlapping black numeric characters printed on a white background. FIG. 9 shows an example of a densely packed or closely packed numeric background formed by printing a high concentration of overlapping dark numeric characters on a white background. FIG. 10 shows an example of a patterned background formed of a woven pattern. FIG. 11 shows an example of a densely packed or closely packed numeric background formed by printing a high concentration of overlapping white numeric characters on a black background. FIG. 12 shows a background pattern having an irregular distribution of light-colored amorphous forms placed over a dark or colored/tinted background. FIG. 13 shows a background pattern having an irregular distribution of dark or colored/tinted amorphous forms placed over a light background.

The graphics of the background patterns need not be limited to those specifically depicted; complex patterns, such as overlapping random alpha characters or other complex graphics or symbols, can be used so long as the elements forming the pattern are sufficiently sized and detailed so as to make the graphics or characters printed or produced thereon blend and be somewhat difficult to ascertain.

In some applications it may be desired to combine several different patterns to form a single background. Alternatively, several different background patterns may be printed on different portions of the substrate surface, each adapted for printing of different sets or types of indicia thereon. Several patterned areas may even be printed in adjacent areas on the substrate surface, so that consecutive lines of text are printed on different backgrounds. Multiple colors may be employed to further enhance the concealing characteristics of the camouflage background pattern 26.

Validation mark 5 may generally comprise any form of physical document verification which cannot be accurately duplicated or counterfeited by conventional means, but which can be used to instantly identify an original document as opposed to a duplicate. A preferred embodiment of validation mark 5 comprises a latent validation image 30 which is not normally visible when document 2 is viewed at relatively perpendicular or oblique angles, but which is rendered clearly visible when document 2 is viewed at certain specified viewing angles or positions. The ability to mask the latent validation image 30 at perpendicular viewing angles prevents the accurate duplication of the document 2 by convention scanning or photocopy devices, since these copying devices typically "view" documents at an angle which is perpendicular relative to the original document 2.

Figure 6:
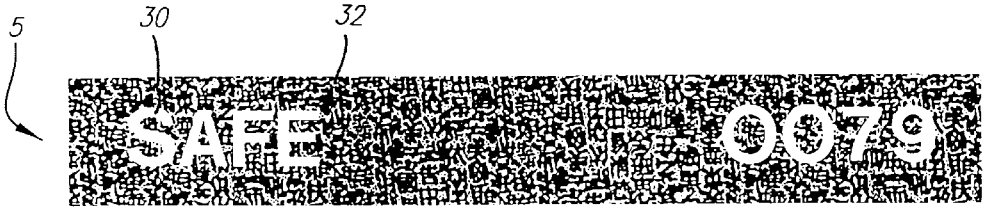
FIG. 6 shows an embodiment of a validation mark employing a complex background pattern.

One embodiment of a validation mark 5 useful in the present invention comprises the use of a latent validation image 30 which is overprinted onto a camouflage background pattern 32 (FIG. 6). The preferred camouflage background patterns 32 for validation mark 5 is printed onto the document surface and is preferably formed of randomly selected alphanumeric or kanji characters, or woven patterns. A latent validation image 30 (also referred to herein as an "overprint indicia") preferably has different reflective characteristics than the background pattern 32 and has graphics, font size and type particularly selected to coordinate with the camouflage background pattern which is overprinted on at least a portion of the camouflage background pattern. The coordination of the background pattern and the overprinted image renders the overprinted image difficult to read unless a special reading device is utilized or the document is viewed at an angle with respect to incident light to cause a reflection off of the overprinted image. This overprinted image or message can be printed or produced with special inks, metallic foils or other materials that can be visually recognized or ascertained from the background indica but will not be readily present in a scanned or photocopied image. Copied images, therefore, will be obscured by the camouflage background pattern.

The patterned background 32 employed in validation mark 5 preferably comprises a complex asymmetrical pattern of alternating black-and-white areas, however, the patterns used in a particular application need not be limited to black-and-white areas; any combination of colors can be used. Other contrasting background patterns 32 useful in the present invention are disclosed in more detail in co-pending U.S. application Ser. No. 08/450,975, which is hereby incorporated by reference in its entirety. The graphics of background pattern 32 are coordinated with the spectral characteristics of latent validation image 30 such that the optical/reflective properties of the combined pattern renders latent validation image 30 "invisible" at relatively perpendicular or oblique angles, thus preventing the accurate duplication or photocopying of the document 2 by convention photocopy devices. The image 30 which is overprinted onto background pattern 32 is preferably comprised of either metallic or magnetic inks.

The graphics patterns employed in thermochromic pantograph 24, as disclosed in FIGS. 4–13, are also particularly well suited to be employed as the camouflage background patterns for validation mark 5. Thus, an alternate embodiment of the present invention may comprise a document 2 wherein the same camouflage background pattern is shared by both the thermochromic pantograph 24 and the validation mark 5. In this embodiment, the placement of the latent validation images 30 may be coordinated with the placement of the latent thermochromic images 6 to fully utilize the camouflaging features of the background pattern 32.

The size of the graphics or text of the latent validation image 30 is preferably selected to correspond to the size of the patterns in the complex patterned background 32 in order to provide maximum camouflaging of the overprinted image. For example, if the background selected is that of overlapping numeric characters as shown in FIGS. 7, 8, 9, or 11, the overprint image font, graphics and design is preferably selected so that the text is approximately the same size and general design as the numerals used to form the background pattern. In addition to size, certain types of background patterns are particularly suitable for certain overprinted latent image font types. For example, it has been observed that latent validation images 30 printed or produced in an open font upon a woven background as shown in FIG. 10 provides particularly good camouflage. Moreover, the camouflaged background pattern may be of varying rather than uniform darkness or complexity, such that the portions of the patterned background are especially complex or dark (or light, where the pattern is one of dark characters printed on a white background) in the areas upon which important indicia are to be overprinted or otherwise produced.

It has also been observed that printing of a latent validation image 30 having reflective properties with certain types of surface textures provides particularly suitable camouflage when used in combination with certain font types and background patterns. For example, an overprint indicia may be applied to the substrate surface such that the overprinted or trapped ink layer is uniform and smooth, or it may be of an uneven texture. The particular texture or form of printing or stamping selected may be varied depending upon the background pattern selected, the degree of protection desired and the particular application.

In use, a validation mark 5 may include a latent validation image 30 formed as a special overprint or metallic layer over the patterned area 32. The patterned background serves to camouflage the indicia making the indicia difficult to read when the document is viewed at an angle perpendicular to its surface. However, when the document is viewed obliquely such that incident light reflects off of the overprint indicia at an acute angle relative to the document surface, the reflected light acts to increase the contrast between the overprint indicia and the background pattern such that the indicia may be more easily read.

If an original document including a reflective or metallic overprint latent validation mark 30 is copied, as by computer or electronic scanning or color xerographic photocopying, the copies will not include this reflective or metallic indicia. Since modern scanners and color copiers generally produce duplicate images by focusing a light on the surface of the original and performing a color analysis of the light absorbed by various parts of the original, they do not accurately reproduce true colors when specular reflections are produced from the surface of the original. Instead, the overprint indicia 30 will be reproduced on the duplicate in ink (or toner) of a color different than the color of the reflective material or metal on the original, and the duplicate image of the indicia will be partially obscured or hidden by the complex patterned background 32, so that the indicia 30 can only be read with difficulty, if at all. Thus, the indicia on the duplicate will be at least partially camouflaged.

In some applications, it may be desirable to completely obscure the overprint indicia on a copy by providing a more complex pattern or overprinting the overprint indicia in a similar colored ink (as described in U.S. patent application Ser. No. 08/291,873, which is hereby incorporated herein in its entirety by reference) so that the indicia cannot be read after being copied or scanned; however, for other applications, the overprint indicia need only be partially obscured so that reading is made more difficult on the copy. In the latter case, when a person such as a bank teller is confronted with a duplicate or copy, the obscuring of the indicia due to copying will require the teller to pause and look carefully at the obscured text. When he or she does so, the legend printed on the check will inform him that a check which does not include for example, a reflective image, is not an original. Because the partial obscuring of the copied indicia by the photocopied patterned area forces viewers to look very carefully at the document, viewers such as bank tellers are prevented from absently glancing at a copied document and, by failing to see the legend or read all of the fine print on the document, carelessly processing it as an original.

An alternate example of a validation mark 5 suitable for the present invention is disclosed in U.S. Pat. No. 5,344,192, which was issued to the same inventor as the present application, and which is hereby incorporated by reference in its entirety as if fully set forth herein. In this embodiment, the latent validation image 30 comprises an ink which preferably has a color which is substantially the same as the color of the underlying substrate 4, but the ink of latent validation mark 5 possesses more uniform directional reflective qualities. As such, when the document 2 is viewed from a relatively perpendicular angle, the refection of light from the ink of the latent validation mark 30 may differ only slightly from the reflected light from the substrate 4, thus the latent validation mark 30 appears hidden. But when the document 2 is viewed at a relative angle which is not perpendicular to the substrate 4, the latent validation image 30 is rendered visible because of the contrast in quality of the reflected light rays from the ink of validation mark 30 and the light rays reflected from substrate 4.

Referring to FIGS. 14–15, another embodiment of a validation mark 5 useful in the present invention comprises a pattern of relief impressions on a document having a plurality of distinct and contrasting relief structures, which forms a visible validation image when observed at the correct viewing angle(s), but which is "hidden" or concealed when observed at an incorrect viewing angle. The contrasting optical properties between the surface relief patterns of a background structure 36 and validation image structure 38 allows the formation of a "latent" image which is hidden when viewed at an incorrect viewing angle, but which forms a "visible" image when viewed at the correct viewing angle(s) $\theta$. The background structure 36 is preferably coordinated with the image structure 38 such that the latent image is not visible when viewed at an angle perpendicular relative to document 2, thus preventing the accurate duplicating or counterfeiting of the document by conventional photocopy or scanning devices. Because of the differing surface relief between the two structures, incident light rays which reflect from the background structure 36 would be different in intensity and character from light rays which reflect from the image structure 38. As described in more detail in co-pending application Ser. No. 08/568,587 (which is incorporated by reference in its entirety), the reflected light rays may be diffractionally and/or diffusionally modified by the surface relief pattern of the two structures. It is this contrast in reflected light between the two structures which allows the formation of a latent image pattern and which renders the latent image visible when document 2 is viewed at relative angle(s) $\theta$. The height H1 and H2, width W, and spacing of the relief structures in shown in FIGS. 14–15 are for purposes of illustration only, and are not intended to be limiting in any way.

An alternative embodiment of the present invention may include a thermal verification mark 8 (FIG. 1) which is preferably positioned along the surface of document 2. On documents 2 having thermal verification mark 8, the authenticity of the document 2 can be verified by applying heat to these overt thermal marks which are placed onto the document. For example, the genuineness of document 2 can be verified by rubbing at the thermal verification marks so as to frictionally create heat, wherein the thermal verification mark changed color, thereby verifying the genuineness of the document 2. The positioning of thermal verification mark 8 in FIG. 1 is shown for the purposes of illustration only, and is not intended to be limiting in any way, since thermal verification mark 8 may be positioned anywhere on the document 2. Since conventional photocopiers cannot accurately produce a copy containing these thermal-reactive properties, a duplicate or counterfeit can be easily detected by the absence of such a thermal verification mark.

The preferred process for printing the thermochromic pantograph 24 will now be discussed. In the preferred embodiment, the thermochromic pantograph 24 is offset printed onto substrate 4. The non-thermochromic ink of the background structure 26 (preferably conventional lithography ink in a matching color) is preferably applied to substrate 4 prior to the application of the thermochromic ink of the latent image 6 to facilitate proper trapping and to minimize damage or modifications to the heat crystals within the thermochromic ink. The thermochromic pantograph 24 is preferably trap produced to eliminate "white" spaces from the surface of document 2. In the preferred embodiment, the graphics of the background pattern 26 are preferably trap produced with the thermochromic ink of the latent image 6 spread and the reverse out portion within the thermochromic pantograph 24 choked at 0.20 points.

Vignette screens are preferably employed during the printing process to lighten or darken particular aspects of the printed image. In the preferred embodiment, the vignette screen used to print both the background pattern 26 and the latent image 6 should be positioned exactly in the same position with the same dot and line alignment to facilitate camouflaging.

The thermochromic pantograph 24 is preferably offset printed onto substrate 4 using a Harris 500 four-color litho offset web press. The press is preferably chemically cleaned and prepared according to specifications and instructions issued by the particular manufacturer of the thermochromic ink employed. Once the correct press/chemical preparation is complete, the press should be calibrated as follows:

(a) the rollers should be set for the proper squeeze pressure settings for proper ink distribution; the preferred settings are between ⅛ in. and 3⁄16 in.;

(b) the rollers should be inspected for pitting and are preferably free of any of pitting;

(c) the rollers should inspected for the proper durameter reading, and preferably have durameter readings below 30;

(d) the blanket and plate packing should be checked to insure proper pressure settings, and preferably all blanket and plate pressures are set at the lowest settings possible while still providing sufficient transfer of ink to facilitate 100% coverage; and (e) Once the operating temperature is established, the temperature should be monitored at the press and inspection station to ensure optimum printing of the thermochromic ink. The proper ink setting may be accessed and/or modified according to the temperature at the press and inspection station. The inspection station is a specified area where the printed sample may be inspected for proper printing/camouflaging. When the preferred thermochromic ink is employed, if the temperature at the press or inspection station is above 75 degrees fahrenheit, it may be observed that once heat crystals are activated, the thermochromic ink may slowly change or lighten in color. Based upon the measured temperature and the printed color of the thermochromic ink, the ink/water setting of the press may be adjusted to facilitate optimum camouflaging. If the room temperature at the press or viewing station moves closer to 80 degrees fahrenheit or higher, the printed sample should be taken to an area that is 75 degrees or cooler in order to properly assess the ink/water settings. The preferred viewing temperature should be at or below 72 degrees fahrenheit. The temperature observation ranges and calibration settings set forth in this paragraph are not intended to be limiting, but instead are the preferred temperature ranges and calibration settings when printing with the preferred thermochromic ink, which is activated by the specified heat levels radiated by a conventional scanner or photocopier. Using other thermochromic inks with different heat-reactive properties may entail different calibration settings and/or temperature observation ranges.

To provide additional protection against the unauthorized alteration of document 2, a preferred embodiment of the thermochromic pantograph 24 may comprise the use of a "soft" formulation of thermochromic ink 12 in the latent image 6. Soft inks will destruct when subjected to abrasive or frictional treatment. This aspect of the present invention is particularly useful when employed within areas of documents 2 where important writing, printing or imprinting of toner or ink is required, for example, at the "pay to the order of" section or "dollar amount" section of a typical check. Attempts to alter the ink pattern which has been applied to these sections of document 2 by mechanical means will typically cause abrasive or frictional pressure to be applied via a rubbing, scraping, or erasing action. Because the soft thermochromic ink will destruct when subjected to abrasive or frictional pressures, any attempt to apply such mechanical forces to the thermochromic pantograph 24 will result in the whole or partial damaging or destruction of the printing of thermochromic pantograph 24. This damaging or destruction of the thermochromic ink renders the document instantly identifiable as possibly being the subject of an unauthorized alteration, since the printing pattern will be disrupted and the underlying color of the substrate 4 will show through.

Although this particular invention has been described in detail with particular reference to the preferred embodiments as illustrated and described herein, as would be obvious to those skilled in the art after a review of the drawings and specification, various modifications may be made which are encompassed by the present invention and the scope of the invention is not to be restricted except within the scope and spirit of the appended claims. For example, although their preferred embodiments disclose a document comprising both thermochromic pantograph and validation mark, it is contemplated that a document according to the present invention may include only a thermochromic pantograph without a validation mark.

What is claimed is:

1. A tamper and counterfeit resistant document comprising:

a first surface and a second surface, a thermochromic pantograph on said first surface, and a validation mark; said thermochromic pantograph comprising a latent image and a camouflage pattern; said camouflage pattern comprising a graphic having printed areas and areas without print, said printed areas and said areas without print forming said graphic; said validation mark comprising a latent validation image.

2. The tamper and counterfeit resistant document of claim 1 wherein said thermochromic pantograph is subject to visible spectral changes when exposed to temperature changes exceeding at least one thermo-activation temperature level.

3. The tamper and counterfeit resistant document of claim 2 wherein said at least one thermo-activation temperature level is the radiant temperature range of a photocopier or scanner.

4. The tamper and counterfeit resistant document of claim 2 wherein said visible spectral changes are irreversible.

5. The tamper and counterfeit resistant document of claim 2 wherein said visible spectral changes are reversible.

6. The tamper and counterfeit resistant document of claim 1 wherein said thermochromic pantograph comprises soft thermochromic ink.

7. The tamper and counterfeit resistant document of claim 1 wherein said thermochromic pantograph comprises thermochromic ink having heat crystals.

8. The tamper and counterfeit resistant document of claim 1 wherein said latent image becomes visible when exposed to specific temperature levels.

9. The tamper and counterfeit resistant document of claim 8 wherein said latent image comprises thermochromic ink.

10. The tamper and counterfeit resistant document of claim 1 wherein said camouflage pattern comprises non-thermochromic ink.

11. The tamper and counterfeit resistant document of claim 1 wherein said camouflage pattern comprises a pattern of intercrossing and interspaced lines.

12. The tamper and counterfeit resistant document of claim 1 wherein said validation mark comprises relief impressions having a plurality of distinct and contrasting relief structures.

13. The tamper and counterfeit resistant document of claim 1 further comprising a thermal verification mark.

14. A method of making a document comprising the steps of:

applying a thermo-activated latent image in a first location on a first surface of a substrate; and forming a validation mark on said substrate, said validation mark formed on said substrate in a second location separately from said thermo-activated latent image.

15. The method of claim 14 wherein said applying step comprises the steps of:

trapping a background pattern of non-thermochromic ink onto a substrate;

spreading a latent image layer of thermochromic ink over said background pattern.

16. The method of claim 14 wherein said applying step comprises the step of offset printing said thermo-activated latent image.

17. A tamper and counterfeit-resistant document comprising:

a substrate;

a thermo-activated pantograph formed on the surface of said substrate, said thermo-activated pantograph having a latent image pattern and a background; and a validation mark, said validation mark formed on said substrate separately from said thermo-activated pantograph.

18. The tamper and counterfeit resistant document of claim 17 wherein said background comprises a camouflaged background pattern.

19. The tamper and counterfeit resistant document of claim 18 wherein said validation mark comprises relief impressions having a plurality of distinct and contrasting relief structures.

20. The tamper and counterfeit resistant document of claim 17 further comprising a thermal verification mark.

21. The tamper and counterfeit resistant document of claim 1, wherein said validation mark is on said first surface.

22. The tamper and counterfeit resistant document of claim 1, wherein said validation mark is on said second surface.

23. The tamper and counterfeit resistant document of claim 1, wherein said camouflage pattern is irregular.

24. The tamper and counterfeit resistant document of claim 1, wherein said thermochromic pantograph is in a first location on said document, and said validation mark is in a second location on said document, said second location and said first location not coincident.

25. A document comprising:

a substrate;

a thermo-activated latent image disposed on a first location of said substrate; and a patterned background disposed on said first location of said substrate, said patterned background comprising a graphic, said graphic comprising a first area having a first color and a second area having a second color, said second color different from the first color.

26. The document of claim 25, wherein said first color is black and said second color is white.

27. The document of claim 25, wherein said latent image visibly appears when exposed to a radiant temperature range of a photocopier or scanner, and said latent image is obscured by said patterned background when exposed to a temperature outside said radiant temperature range of a photocopier or scanner.

28. The document of claim 25, wherein said first area of said graphic comprises ink having a first color, and said second area of said graphic comprises ink having a second color different from said first color.

29. The tamper and counterfeit resistant document of claim 25 wherein said patterned background is irregular.

30. The document of claim 25, wherein said graphic comprises intercrossing and interspaced lines.

31. The document of claim 25, wherein said graphic comprises shaded blocks having contours, and wherein said latent image comprises characters aligned within said contours of said blocks.

32. The tamper and counterfeit resistant document of claim 17, wherein said validation mark comprises a latent validation image detectable on said document and substantially undetectable on a reproduction of said document.

* * * * *

UNITED STATES PATENT AND TRADEMARK OFFICE
Certificate

Patent No. 5,873,604 Patented: February 23, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: George K. Phillips, Paso Robles, CA; and Lyle D. Small, Colorado Springs, CO.

Signed and Sealed this Tenth Day of January 2006.

BOYER D. ASHLEY
*Supervisory Patent Examiner*
Art Unit 3722